US007892653B2

(12) United States Patent
Tanimoto et al.

(10) Patent No.: US 7,892,653 B2
(45) Date of Patent: Feb. 22, 2011

(54) TITANIUM ALLOY COMPOSITE MATERIAL, TITANIUM CLAD MATERIAL USING THE TITANIUM ALLOY COMPOSITE MATERIAL, AND METHOD OF PRODUCING THE TITANIUM CLAD MATERIAL

(75) Inventors: Toshio Tanimoto, Toky (JP); Hidekazu Takizawa, Nagano (JP)

(73) Assignees: E & F Corporation, Hachioji-shi, Tokyo (JP); Nagano Prefecture, Nagano-shi, Nagano (JP)

( * ) Notice: Subject to any disclaimer, the term of this patent is extended or adjusted under 35 U.S.C. 154(b) by 259 days.

(21) Appl. No.: 11/571,434

(22) PCT Filed: Aug. 22, 2006

(86) PCT No.: PCT/JP2006/316408

§ 371 (c)(1),
(2), (4) Date: Dec. 29, 2006

(87) PCT Pub. No.: WO2007/029487

PCT Pub. Date: Mar. 15, 2007

(65) Prior Publication Data

US 2008/0292899 A1 Nov. 27, 2008

(30) Foreign Application Priority Data

Sep. 7, 2005 (JP) ..... 2005-259797

(51) Int. Cl.
*B32B 5/02* (2006.01)
*B32B 15/16* (2006.01)
*B22F 7/04* (2006.01)

(52) U.S. Cl. ..... 428/564; 428/553; 428/660; 428/661; 419/11; 419/14; 228/193

(58) Field of Classification Search ..... None
See application file for complete search history.

(56) References Cited

U.S. PATENT DOCUMENTS 4,072,516 A 2/1978 Pepper et al.

(Continued)

FOREIGN PATENT DOCUMENTS

JP 49-102519 9/1974

(Continued)

OTHER PUBLICATIONS

Arvieu, C. et al. "The design of an ephemeral interfacial zone for titanium matrix composites", *Composites, IPC Business Press Ltd.*, vol. 29, No. 9-10, pp. 1193-1201, (Oct. 9, 1998).

(Continued)

*Primary Examiner*—Jennifer C McNeil
*Assistant Examiner*—Jason L Savage
(74) *Attorney, Agent, or Firm*—Leydig, Voit & Mayer, Ltd.

(57) ABSTRACT

A titanium alloy composite material including dispersed carbon fibers coated with a layer containing an element which forms a carbide in reaction with carbon, and the carbide formed thereby, in crystal grains of the titanium alloy. The element which forms a carbide in reaction with carbon is preferably at least one of silicon (Si), chromium (Cr), titanium (Ti), vanadium (V), tantalum (Ta), molybdenum (Mo), zirconium (Zr), boron (B), and calcium (Ca). The carbon fibers are preferably carbon nanotubes, vapor-grown carbon fibers, or a mixture thereof. The titanium alloy composite material has excellent mechanical strength, such as tensile strength, Young's modulus, toughness, and hardness.

10 Claims, 7 Drawing Sheets

U.S. PATENT DOCUMENTS

| | | | | | |
|---|---|---|---|---|---|
| 4,132,828 | A | * | 1/1979 | Nakamura et al. | 428/366 |
| 4,223,075 | A | * | 9/1980 | Harrigan et al. | 428/610 |
| 4,853,294 | A | | 8/1989 | Everett et al. | |
| 5,227,249 | A | * | 7/1993 | Lukco et al. | 428/614 |
| 5,426,000 | A | * | 6/1995 | Labib et al. | 428/547 |
| 5,697,421 | A | * | 12/1997 | Lin et al. | 164/105 |
| 6,210,283 | B1 | * | 4/2001 | Wojciechowski et al. | 464/181 |
| 6,277,318 | B1 | * | 8/2001 | Bower et al. | 264/346 |
| 2005/0075708 | A1 | * | 4/2005 | O'Brien et al. | 607/116 |
| 2005/0181209 | A1 | * | 8/2005 | Karandikar | 428/408 |
| 2007/0134496 | A1 | * | 6/2007 | Katagiri et al. | 428/408 |

FOREIGN PATENT DOCUMENTS

| | | | | |
|---|---|---|---|---|
| JP | 57-164947 | | | 10/1982 |
| JP | 57-169039 | | | 10/1982 |
| JP | 1-195250 | | | 8/1989 |
| JP | 3-54182 | A | | 3/1991 |
| JP | 10-265869 | | | 10/1998 |
| JP | 2002-000971 | | | 1/2002 |
| JP | 2004-225765 | | | 8/2004 |
| JP | 2004-225084 | | | 8/2006 |
| JP | 2004-225764 | | | 8/2006 |
| WO | 2005/040066 | | * | 5/2005 |

OTHER PUBLICATIONS

Warrier, S.G. et al.; "Using Rapid Infrared Forming to Control Interfaces in Titanium-Matrix Composites", *JOM, Minerals, Metals, & Materials Society*, vol. 45, No. 3, pp. 24-27, (Mar. 1, 1993).

* cited by examiner

Cr−Kα

TITANIUM ALLOY COMPOSITE MATERIAL, TITANIUM CLAD MATERIAL USING THE TITANIUM ALLOY COMPOSITE MATERIAL, AND METHOD OF PRODUCING THE TITANIUM CLAD MATERIAL

TECHNICAL FIELD

The present invention relates to a titanium alloy composite material, a method of producing the titanium alloy composite material, a titanium clad material using the titanium alloy composite material, and a method of producing the titanium clad material.

BACKGROUND ART

Titanium alloys have high relative strength and excellent corrosion resistance, and have mainly been used in the fields of aerospace, deep sea exploration, chemical plants, and the like. Recently, titanium alloys have been widely used for consumer uses such as heads or shafts of golf clubs, components of watches or fishing goods, and eyeglass frames.

Recently, composite materials containing a titanium alloy and carbon fiber combined for further improving mechanical properties such as tensile strength and toughness have been proposed. For example, Patent Documents 1 and 2 each disclose an automobile component formed of a titanium alloy containing carbon fibers such as carbon nanofibers. Patent Documents 1 and 2 each further describe injecting ions of oxygen (O), nitrogen (N), chlorine (Cl), chromium (Cr), carbon (C), boron (B), titanium (Ti), molybdenum (Mo), phosphorus (P), aluminum (Al), and the like into the carbon nanofibers, to thereby improve wetness and adhesiveness between the carbon nanofibers and metal. Further, pure titanium has also been cladded to a side surface of a core material made of a titanium alloy, for example, for obtaining functions and properties that cannot be obtained with a single substance (see Patent Document 3, for example).

Patent Document 1: JP 2004-225084

Patent Document 2: UP 2004-225765

Patent Document 3: JP 2002-000971

DISCLOSURE OF THE INVENTION

Problem to be Solved by the Invention

The inventors of the present invention, after diligent study, have found that in the conventional techniques disclosed in Patent Documents 1 and 2, titanium and carbon fibers react with each other during formation of a composite. Thus, the inventors of the present invention have found that the original properties of the carbon fibers as a reinforcing material are significantly degraded, and mechanical strength as expected cannot actually be obtained. Further, as described in the above-mentioned Patent Documents, it is also found that use of carbon nanofibers subjected to ion injection treatment as a carbon fiber has improved dispersibility of the carbon nanofibers in an alloy, however, reactivity of the carbon nanofibers with titanium is rather accelerated, and mechanical strength of the carbon nanofibers is somewhat reduced. In the conventional technique disclosed in Patent Document 3, mechanical properties of both a titanium alloy and pure titanium are originally not sufficient, and thus cladding of the titanium alloy and pure titanium provides no clad material having remarkably improved mechanical properties.

Therefore, the present invention has been made in view of solving the problems described above, and an object of the present invention is to provide a titanium alloy composite material having excellent mechanical strength such as tensile strength, Young's modulus, toughness and hardness.

Another object of the present invention is to provide a titanium clad material having remarkably improved mechanical properties such as tensile strength, elongation and fracture toughness.

Means for Solving the Problems

The inventors of the present invention, after conducting intensive studies and development for solving the conventional problems described above, have found that dispersion of carbon fibers coated with a layer containing an element which forms carbide in reaction with carbon and the carbide formed thereby in crystal grains of titanium alloy is effective for solving the problems, to complete the present invention. Further, the inventors of the present invention have found that a clad material obtained by cladding this titanium alloy composite material and a titanium alloy having a high fracture toughness has remarkably improved mechanical properties such as tensile strength, elongation and fracture toughness.

That is, a titanium alloy composite material according to the present invention is characterized by dispersing carbon fibers coated with a layer containing an element which forms carbide in reaction with carbon and the carbide formed thereby in crystal grains of the titanium alloy.

It is preferable that the element which forms carbide in reaction with carbon include at least one selected from the group consisting of silicon (Si), chromium (Cr), titanium (Ti), vanadium (V), tantalum (Ta), molybdenum (Mo), zirconium (Zr), boron (B) and calcium (Ca).

It is preferable that the carbon fibers include carbon nanotubes, vapor-grown carbon fibers or a mixture thereof. The titanium alloy composite material preferably comprises 0.1% to 10% by mass of the carbon fibers. The layer preferably has a thickness of at least 0.5 nm.

A method of producing a titanium alloy composite material according to the present invention is characterized by comprising: a step of mixing carbon fibers and powder of an element which forms carbide in reaction with carbon, and then sublimating the element under high temperature vacuum to coat the carbon fibers with a layer containing the element and the carbide; a step of mixing the carbon fibers obtained in the former step and titanium alloy powder, and applying mechanical impact force on the mixture to fix the carbon fiber on a surface of the titanium alloy powder; a step of sintering the carbon fiber-fixed titanium alloy powder obtained in the former step; and a step of plastic working the sintered body obtained in the former step to disperse the carbon fiber in crystal grains of the titanium alloy.

It is preferable that a method of producing a titanium alloy composite material further comprises a step of aging the plastic-worked titanium alloy composite material. The sintering is preferably conducted by a pulse electric current sintering method. The plastic working is preferably conducted by at least one process selected from a hot rolling process and an iso thermal forging process.

The titanium clad material according to the present invention is characterized in that a titanium alloy composite material with carbon fibers coated with a layer containing an element which forms carbide in reaction with carbon and the carbide formed thereby dispersed in crystal grains of the titanium alloy, and a titanium alloy having a higher fracture toughness than that of the titanium alloy composite material are sinter bonded to one another. Further, it is preferable that the titanium clad material comprise a pair of sheet materials made of the titanium alloy having a higher fracture toughness than that of the above-mentioned titanium alloy composite maternal, and a core material made of the above-mentioned titanium alloy composite material arranged between the sheet materials. The core material preferably has a honeycomb structure.

A method of producing a titanium clad material according to the present invention is characterized by comprising: laminating in a mold a titanium alloy composite material with carbon fibers coated with a layer containing an element which forms carbide in reaction with carbon and the carbide formed thereby dispersed in crystal grains of the titanium alloy, and a titanium alloy having a higher fracture toughness than that of the titanium alloy composite material; and sinter bonding the titanium alloy composite material and the titanium alloy to one another by a pulse electric current sintering method.

EFFECT OF THE INVENTION

According to the present invention, a titanium alloy composite material having excellent mechanical strength such as tensile strength, Young's modulus, toughness and hardness, and a method of producing the same can be provided.

Further, according to the present invention, a titanium clad material having remarkably improved mechanical properties such as tensile strength, elongation and fracture toughness, and a method of producing the same can be provided.

BEST MODE FOR CARRYING OUT THE INVENTION

Figure 1:
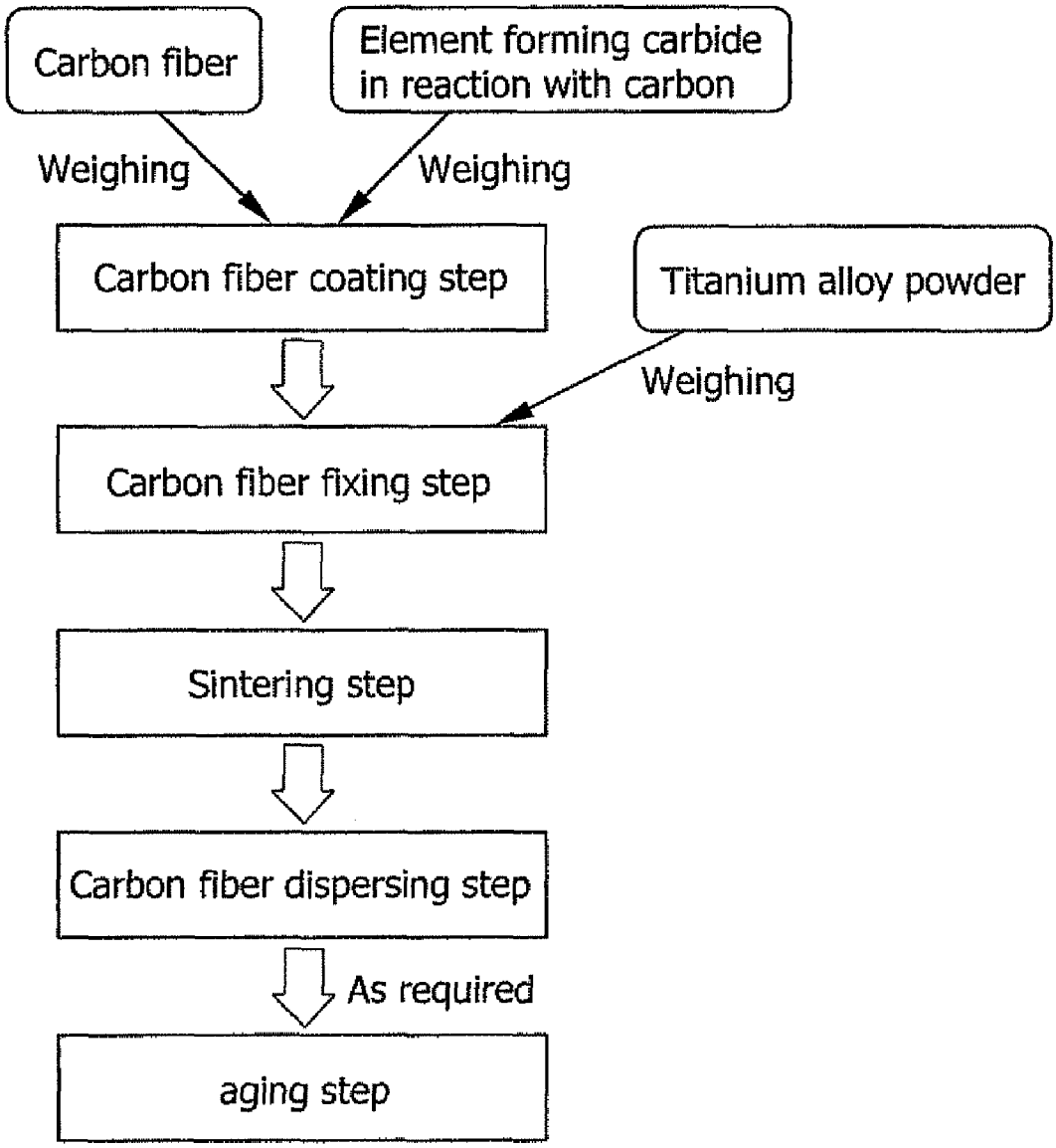
FIG. 1 A flow chart explaining a method of producing a titanium alloy composite material of the present invention.

Hereinafter, the present invention will be described in more detail.

(Titanium Alloy Composite Material)

A titanium alloy composite material of the present invention is obtained by dispersing carbon fibers coated with a layer containing an element which forms carbide in reaction with carbon and the carbide formed thereby in crystal grains of the titanium alloy. That is, the layer coating the carbon fibers is formed of the carbide formed through a partial reaction between the element and the carbon fibers, and an unreacted element. This layer serves as a layer for suppressing reactions between the carbon fibers and titanium during formation of a composite and improves wetness with the titanium alloy, and thus properties of the carbon fibers as a reinforcing material are maintained after formation of the composite. In the present invention, such coated carbon fibers are dispersed in crystal grains, to thereby significantly improve mechanical strength such as tensile strength, Young's modulus, toughness and hardness. In the present invention, a state in which the carbon fibers are dispersed in crystal grains of the titanium alloy refers to a state in which the carbon fibers are at least partly incorporated in fine crystal grains of the titanium alloy while moderate dispersibility is maintained through plastic flow during plastic working.

Meanwhile, the inventors of the present invention have confirmed that, in the case where the coated carbon fibers are not dispersed in the crystal grains, sufficient mechanical strength cannot be obtained with a titanium alloy composite material prepared by mixing coated carbon fibers and titanium alloy powder and then sintering the mixture. The mechanical strength is presumably reduced because the carbon fibers or TiC as carbide of the carbon fibers forms a brittle layer having a high hardness at a titanium alloy crystalline interface, and the brittle layer having a high hardness serves as a defect causing cracks.

The fiber diameter, fiber length, shape, and the like of the carbon fibers of the present invention are not particularly limited, and a conventionally known carbon fiber generally used as a reinforcing material can be used without limitation. Of those, carbon nanotubes, a vapor-grown carbon fiber, or a mixture thereof is preferably used from the viewpoint of further improving the mechanical properties. Examples of carbon nanotubes include monolayer carbon nanotubes and multilayer carbon nanotubes each formed by a vapor phase growth method, an arc discharge method, a laser vaporization method, or the like. Examples of vapor-grown carbon fibers include discontinuous carbon fibers obtained through crystal growth in a vapor phase by a vapor phase growth method, and a graphite fiber. The vapor-grown carbon fibers may have any shape such as acicular, coiled, tubular, or cup, and two or more kinds thereof may be blended. From the viewpoint of further improving the properties of a reinforcing material and the dispersibility in a titanium alloy, the carbon nanotubes preferably have a fiber diameter of 2 nm to 80 nm and a fiber length of 1 μm to 100 μm, and the vapor-grown carbon fibers preferably have a fiber diameter of 80 nm to 200 nm and a fiber length of 5 μm to 100 μm.

The fiber diameter, fiber length, and shape of the carbon fibers in the titanium composite material can be measured through structural observation with an ultra high resolution FE-SEM or a transmission electron microscope.

The content of the carbon fibers is preferably 0.1% to 10% by mass, more preferably 0.2% to 5.0% by mass, and most preferably 0.4% to 3.0% by mass with respect to the titanium alloy composite material.

The content of the carbon fibers within the above ranges allows further improvement in mechanical properties.

Note that the content of the carbon fibers in the titanium composite material can be measured through structural observation with an ultra high resolution FE-SEN or a transmission electron microscope, and elemental analysis and analysis in accordance with "JIS H1617 Methods for determination of carbon in titanium and titanium alloys".

In the present invention, the element coating the carbon fibers is not particularly limited as long as the element is capable of forming carbide in reaction with carbon. The element is preferably at least one selected from the group consisting of silicon (Si), chromium (Cr), titanium (Ti), vanadium (V), tantalum (Ta), molybdenum (Mo), zirconium (Zr), boron (B) and calcium (Ca). The element is more preferably at least one selected from silicon (Si) and chromium (Cr). The elements exemplified are capable of further improving the mechanical properties because the carbide of the elements has excellent compatibility with the titanium alloy.

The thickness of the layer containing the above-mentioned element and the carbide of the element is preferably at least 0.5 nm, more preferably 2 nm to 50 nm from the viewpoint of further improving the mechanical strength by dispersion enhancement into the titanium alloy, and particularly preferably 0.5 nm to 10 nm in the case where carbon nanotubes are used as the carbon fiber.

Note that structural observation with an ultra high resolution FE-SEM or a transmission electron microscope can confirm whether or not the carbon fiber is coated with the layer containing the element and the carbide of the element.

The titanium alloy to be used for preparation of the titanium alloy composite material may have any crystal structure such as: an α-structure (such as Ti—O or Ti-5Al-2.5Sn); a near α-structure (such as Ti-6Al-5Zr-0.5Mo-0.2Si, Ti-5.5Al-3.5Sn-3Zr-0.3Mo-1Nb-0.3Si, Ti-8Al-1Mo-1V, or Ti-6Al-2Sn-4Zr-2Mo); an α+β-structure (such as Ti-6Al-4V, Ti-6Al-6V-2Sn, Ti-6Al-2Sn-4Zr-6Mo, or Ti-4.5Al-3V-2Mo-2Fe); a near β-structure (such as Ti-5Al-2Sn-2Zr-4Mo-4Cr or Ti-10V-2Fe-3Al); or a β-structure (such as Ti-15Mo-5Zr-3Al, Ti-11.5Mo-6Zr-4.5Sn, Ti-15V-3Cr-3Al-3Sn, Ti-15Mo-5Zr, or Ti-13V-11Cr-3Al). Further, a titanium alloy (e.g., a titanium alloy containing Ti-15V-6Cr-4Al as a base and TiB and/or TiC added in a small amount, or a titanium alloy containing Ti-22V-4Al as a base and TiB and/or TiC added in a small amount) containing fine particles of TiB and/or TiC dispersed in a metal structure and disclosed in JP-A-2005-76052 can preferably be used. In consideration of the mechanical strength of the titanium alloy composite material to be obtained eventually, preferred examples of the titanium alloy include Ti-6Al-4V, Ti-15Mo-5Zr-3Al, Ti-15V-3Cr-3Al-3Sn, Ti-10V-2Fe-3Al, Ti-4.5Al-3V-2Mo-2Fe, and a titanium alloy disclosed in JP-A-2005-76052.

(Method of Producing Titanium Alloy Composite Material)

Next, a method of producing the titanium alloy composite material of the present invention will be described.

FIG. 1 is a flow chart explaining a method of producing the titanium alloy composite material of the present invention. This method of producing the titanium alloy composite material of the present invention is characterized by including: a carbon fiber coating step of coating carbon fibers with a layer containing an element which forms carbide in reaction with carbon and the carbide formed thereby; a carbon fiber fixing step of fixing the carbon fibers on a surface of titanium alloy powder; a sintering step of sintering the carbon fiber-fixed titanium alloy powder; and a carbon fiber dispersing step of dispersing the carbon fiber in crystal grains of titanium alloy.

(1) Carbon Fiber Coating Step

The carbon fiber coating step of the present invention refers to a step of coating the carbon fibers with the layer containing an element which forms carbide in reaction with carbon and the carbide formed thereby. In this step, the carbon fibers and powder formed of the element which forms carbide in reaction with carbon are charged into a mixing vessel provided with a stirring mixer or the like, and the whole is mixed for about 15 to 30 minutes. The carbon fiber may employ the same carbon fiber as that exemplified in the description of the titanium alloy composite material. The powder to be used only needs to be formed of the element which forms carbide in reaction with carbon, and is formed of at least one selected from the group consisting of silicon (Si), chromium (Cr), titanium (Ti), vanadium (V), tantalum (Ta), molybdenum (Mo), zirconium (Zr), boron (B) and calcium (Ca). The particle shape and average particle size of the powder are not particularly limited, but use of powder having an average particle size of 10 μm to 50 μm allows further improvement in dispersibility of the carbon fiber.

Next, the mixture taken out of the mixing vessel is filled in an unsealed vessel allowing air flow between inside and outside of the unsealed vessel. The unsealed vessel is placed in a vacuum furnace provided with a sealed furnace body, heating means for heating inside the sealed furnace body and a vacuum pump for creating vacuum inside the furnace body. Then, inside of the furnace body is heated by heating means while the inside of the furnace body is maintained in a vacuum state with the vacuum pump, to thereby sublimate the powder of the element which forms carbide in reaction with carbon. The vapor is brought into contact with the carbon fibers to form a layer covering the surface of the carbon fibers. This layer is made of the carbide formed in reaction between a part of the sublimated element and the carbon fiber, and an unreacted element. The conditions such as degree of vacuum, heating temperature, and heating time may arbitrarily be set in accordance with the kind of powder to be used. However, in consideration of a balance between production cost and quality of the layer covering the surface of the carbon fibers, the conditions preferably include a degree of vacuum of $1\times10^{-2}$ Pa to $1\times10^{-3}$ Pa, a heating temperature of 1,200° C. to 1,500° C., and a heating time of 5 hours to 10 hours, for example. Temperature increase rate and temperature decrease rate are not particularly limited, but are each preferably 100° C./h to 200° C./h.

In this way, the carbon fibers are coated with the element, to thereby suppress a reaction between the carbon fibers and titanium during formation of a composite of the carbon fibers and the titanium alloy.

(2) Carbon Fiber Fixing Step

The carbon fiber fixing step of the present invention refers to a step of fixing the carbon fibers obtained in the carbon fiber coating step described above on the surface of titanium alloy powder. In this step, the carbon fibers obtained in the carbon fiber coating step are mixed with the titanium alloy powder. The mixing ratio of the carbon fibers to the titanium alloy powder is not particularly limited. However, from the viewpoint of further improving the mechanical properties of the titanium alloy serving as a base material, the mixture preferably includes 0.1% to 10% by mass, more preferably 0.2% to 3.0% by mass, and most preferably 0.4% to 1.0% by mass of the carbon fibers. The particle shape and average particle size of the titanium alloy powder are not particularly limited, but use of powder having an average particle size of 10 μm to 50 m allows further improvement in mechanical properties of a composite titanium alloy. In the case where the carbon fiber is included in the mixture in an amount of 3% or more by mass, titanium alloy powder having a small average particle size is preferably used from the viewpoint of suppressing aggregation of the carbon fibers.

Next, mechanical impact force is applied to the mixture of the carbon fibers and the titanium alloy powder to fix the carbon fiber on the surface of the titanium alloy powder. In this way, release of the carbon fibers from the surface of a titanium alloy powder particle is prevented, and a homogeneous sintered body can be obtained in the sintering step described below.

Specific examples of means for applying mechanical impact force include: a stirring device such as a hybridization system providing high mechanical impact force (manufactured by Nara Machinery Co., Ltd.) or a mechanofusion system (manufactured by Hosokawa micron Corporation); a dispersing device employing medium particles; and a dry mixing and stirring device such as a Henschel mixer or a V-type mixer. Of those, the hybridization system capable of applying mechanical impact force including shear force between a rotor and a stator, impact force between particles, and impact force between a particle and a wall of the device in a high speed flow is preferably employed for fixing the carbon fiber on the surface of the titanium alloy powder particle uniformly and rigidly.

(3) Sintering Step

The sintering step of the present invention refers to a step of heating and sintering the carbon fiber-fixed titanium alloy powder obtained in the carbon fiber fixing step described above. In this step, the carbon fiber-fixed titanium alloy powder obtained in the carbon fiber fixing step is formed into a molded product as required, and sintering the molded product by a sintering method conventionally known in the technical field such as a pulse electric current sintering method, a hot press method, a gas pressure sintering method, or a hot isotropic sintering method preferably in vacuum or in an inert gas atmosphere. In the conventional method, titanium and most of the carbon fibers react with each other during sintering. Meanwhile, in the sintering step of the present invention, the reaction between the carbon fibers and titanium is suppressed by the layer covering the carbon fibers (the carbon fibers partly reacts with titanium to form titanium carbide), and the properties of the carbon fiber as a reinforcing material are maintained.

Sintering conditions such as sintering temperature and sintering time may arbitrarily be set in accordance with the sintering method to be employed or the kind of titanium alloy to be used, and the conditions preferably include a sintering temperature of 800° C. to 1,300° C. and a sintering time of 5 minutes to 2 hours, for example.

Of the sintering methods exemplified above, the pulse electric current sintering method is preferably employed from the viewpoint of obtaining a homogeneous sintered body simply in a short sintering time. In the case where sintering is conducted by the pulse electric current sintering method, the carbon fiber-fixed titanium alloy powder or the molded product thereof is filled in a graphite die, and the whole is heated to a temperature of 850° C. to 950° C. with a temperature increase rate of 50° C./min to 100° C./min, for example for, sintering for 5 minutes to 10 minutes in a degree of vacuum of 4.0 Pa under a compression load of 20 MPa to 30 MPa. In the sintering by the pulse electric current sintering method, neck growth between particles alone is accelerated, and coarsening of particles due to shrinkage between particles hardly occurs. Thus, particle size before sintering is retained, and a sintered body having a fine structure is obtained. In this way, the sintered body has a fine structure, and thus the carbon fiber is easily dispersed in the crystal grains uniformly in the carbon fiber dispersing step described below. As a result, the mechanical strength of the titanium alloy composite material to be obtained improves.

(4) Carbon Fiber Dispersing Step

The carbon fiber dispersing step of the present invention refers to a step of plastic working the sintered body obtained in the sintering step described above for dispersing the carbon fibers in the crystal grains of the titanium alloy. The plastic working may employ a method conventionally known in the technical field without limitation, and examples thereof include a rolling process, a forging process, and an extrusion process. Of those, in order to make the crystal grains more minute and disperse the carbon fibers uniformly, the plastic working preferably employs at least one process chosen from a hot rolling process and an isothermal forging process. In particular, the hot rolling process is preferred because the crystal grains are drawn into a form of fiber for further improving the mechanical strength of the titanium alloy composite material.

In the case where the sintered body is subjected to plastic working through the hot rolling process, rolling conditions such as rolling speed, rolling temperature, and draft are not particularly limited. However, from the viewpoint of obtaining a titanium alloy composite material having excellent mechanical strength, the conditions preferably include a rolling strain/pass of 0.1 to 0.2, a rolling temperature of 700° C. to 850° C., and a draft of 65% or more. In particular, a draft of less than 65% may undesirably cause insufficient dispersion of the carbon fiber in the crystal grain, and thus the mechanical strength of the titanium alloy composite material may degrade. Note that the term "draft" is defined by $(h_1-h_2)\times 100/h_1$ (wherein: $h_1$ represents a sheet thickness before rolling; and $h_2$ represents a sheet thickness after rolling).

In the case where the titanium alloy composite material is worked for producing a product having axial symmetry such as a gear, working of a sheet material may provide insufficient product precision due to in-plane anisotropy. Thus, it is preferred that a cylindrical sintered body be produced in the sintering step and the plastic working employ a hot extrusion process at preferably 1,000° C. or more and preferably 1,000° C. to 1,100° C. or a swaging process.

(5) Aging Treatment Step

The method of producing a titanium alloy composite material of the present invention preferably further includes a step of subjecting the titanium alloy composite material obtained in the carbon fiber dispersing step described above to aging treatment. Conditions for the aging treatment may arbitrarily be set in accordance with the kind of titanium alloy serving as a base material, and the aging treatment may be conducted at 400° C. to 600° C. for 4 h to 24 h, for example. The titanium alloy composite material is subjected to the aging treatment, to thereby further improve the mechanical strength of the titanium alloy composite material.

(Titanium Clad Material)

A titanium clad material of the present invention is characterized in that the titanium alloy composite material described above, that is, the titanium alloy composite material dispersing carbon fibers coated with a layer containing an element which forms carbide in reaction with carbon and the carbide formed thereby in crystal grains of the titanium alloy, and a titanium alloy having a higher fracture toughness than that of the titanium alloy composite material (herein after, abbreviated as high toughness titanium alloy) are sinter bonded to one another.

Figure 2:
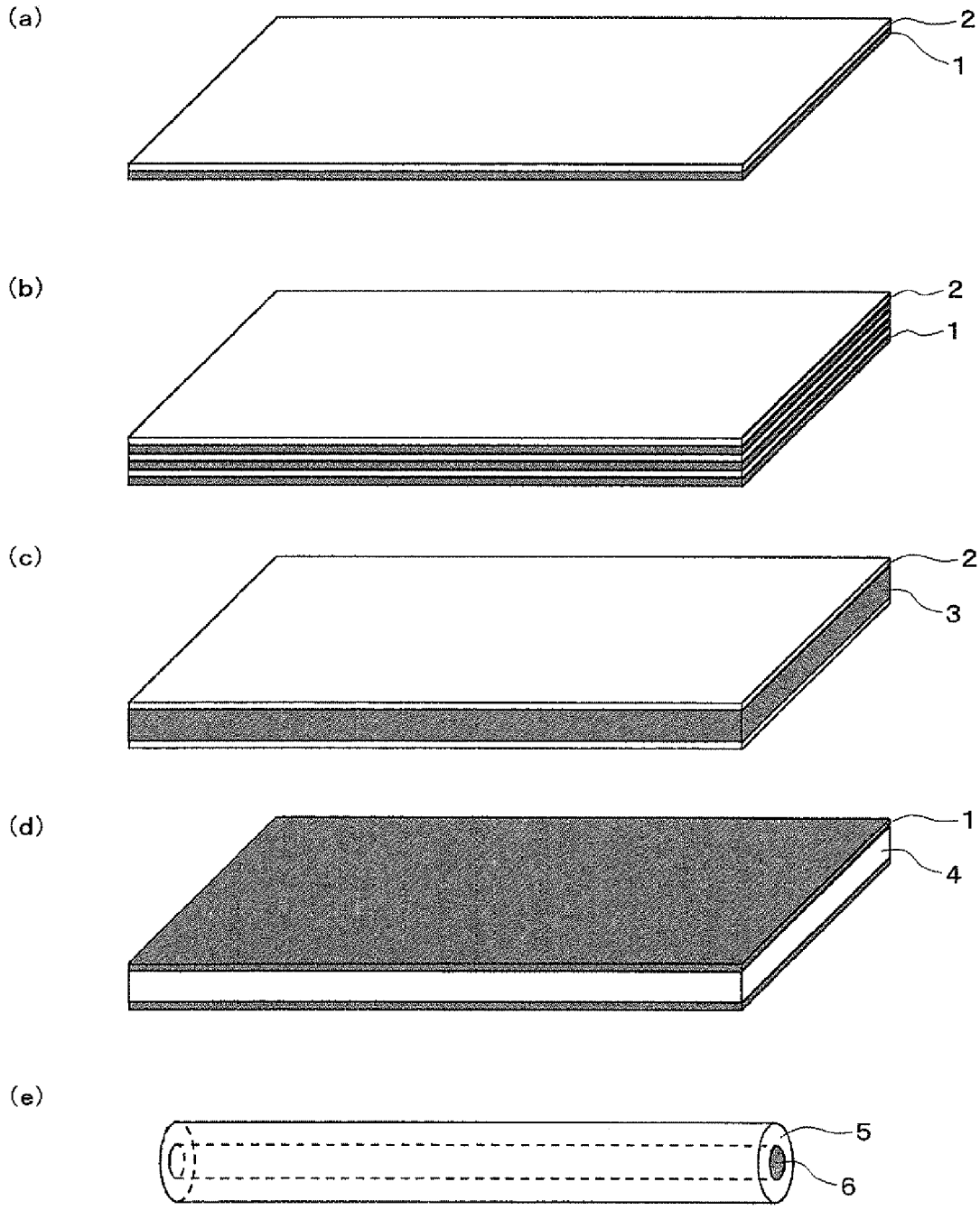
FIG. 2 Diagrams showing examples of a laminate structure of a titanium clad material of the present invention.
Figure 3:
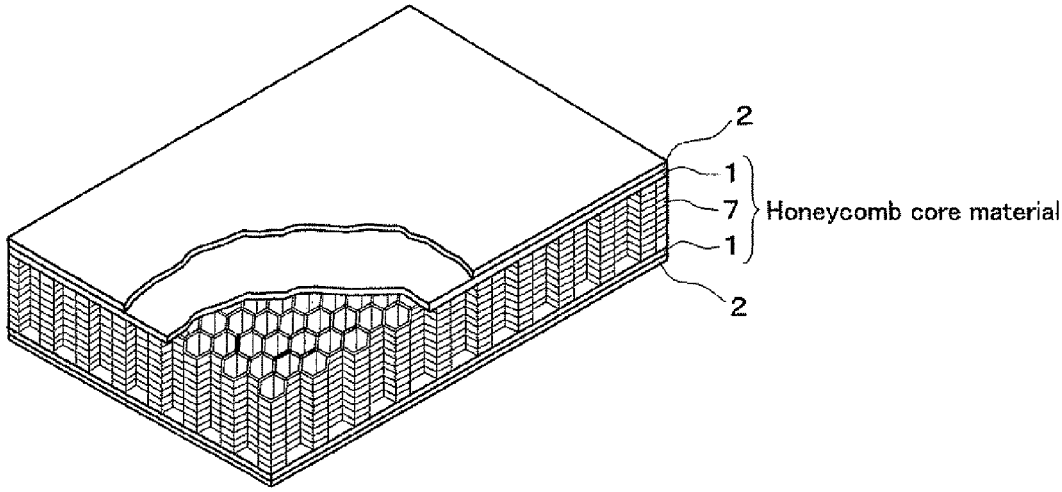
FIG. 3 A diagram showing an example of the most preferred laminate structure of the titanium clad material of the present invention.

FIG. 2 shows examples of a laminate structure of the titanium clad material of the present invention. Examples of the laminate structure of the titanium clad material include: a structure (FIG. 2(*a*)) in which a sheet material 2 formed of the high toughness titanium alloy is stacked on a sheet material 1 formed of the titanium alloy composite material to form a laminate, and the laminate is sinter bonded together; a structure (FIG. 2(*b*)) in which a sheet material 1 formed of the titanium alloy composite material and a sheet material 2 formed of the high toughness titanium alloy are stacked alternatively to form a laminate, and the laminate is sinter bonded together; a sandwich structure (FIG. 2(*c*)) in which a sheet core material 3 formed of the titanium alloy composite material is provided between a pair of sheet materials 2 each formed of the high toughness titanium alloy, that is, a sheet core material 3 formed of the titanium alloy composite material is sandwiched by a pair of sheet materials 2 each formed of the high toughness titanium alloy to form a laminate, and the laminate is sinter bonded together; a sandwich structure (FIG. 2(*d*)) in which a sheet core material 4 formed of the high toughness titanium alloy is provided between a pair of sheet materials 1 each formed of the titanium alloy composite material, that is, a sheet core material 4 formed of the high toughness titanium alloy is sandwiched by a pair of sheet materials 1 each formed of the titanium alloy composite material to form a laminate, and the laminate is sinter bonded together; and a cylindrical structure (FIG. 2(*e*)) in which a cylindrical core material 6 formed of the titanium alloy composite material is inserted into a cylindrical material 6 formed of the high toughness titanium alloy to form a laminate, and the laminate is sinter bonded together. In the structure of FIG. 2(*c*) or (*d*), the sheet core material 3 formed of the titanium alloy composite material or the sheet core material 4 formed of the high toughness titanium alloy may have a honeycomb structure for reduction in weight of the titanium clad material. In consideration of a balance between the mechanical properties and the reduction in weight of the titanium clad material to be obtained eventually, the most preferred structure is the structure shown in FIG. 3 in which: a plurality of sheet materials 7 each formed of the titanium alloy composite material and having a honeycomb structure are stacked together, and the whole is sandwiched by a pair of sheet materials 1 each formed of the titanium alloy composite material to form a honeycomb core material; the honeycomb core material is sandwiched by a pair of sheet materials 2 each formed of the high toughness titanium alloy, and the whole is sinter bonded together. Note that in the structure described above employing the sheet materials 7 each having a honeycomb structure, the pair of sheet materials 1 each formed of the titanium alloy composite material may be omitted. In the laminate structures described above, the size and thickness of the sheet material, core material, and the like may arbitrarily be set in accordance with a product.

(High Toughness Titanium Alloy)

The high toughness titanium alloy to be used in the present invention is not particularly limited as long as the high toughness titanium alloy has a higher fracture toughness than that of the titanium alloy composite material described above. To be specific, a high toughness titanium alloy having a higher fracture toughness than that of the titanium alloy composite material may arbitrarily be selected from titanium alloys such as: an α-structure titanium alloy (such as Ti—O or Ti-5Al-2.5Sn); a near α-structure titanium alloy (such as Ti-6Al-5Zr-0.5Mo-0.2Si, Ti-5.5Al-3.5Sn-3Zr-0.3Mo-1Nb-0.3Si, Ti-8Al-1Mo-1V, or Ti-6Al-2Sn-4Zr-2Mo); an α+β-structure titanium alloy (such as Ti-6Al-4V, Ti-6Al-6V-2Sn, Ti-6Al-2Sn-4Zr-6Mo, or Ti-4.5Al-3V-2Mo-2Fe); a near β-structure titanium alloy (such as Ti-5Al-2Sn-2Zr-4Mo-4Cr or Ti-10V-2Fe-3Al); a β-structure titanium alloy (such as Ti-15Mo-5Zr-3Al, Ti-11.5Mo-6Zr-4.5Sn, Ti-15V-3Cr-3Al-3Sn, Ti-15Mo-5Zr, or Ti-13V-11Cr-3Al); and a titanium alloy (e.g., a titanium alloy containing Ti-15V-6Cr-4Al as a base and TiB and/or TiC added in a small amount, or a titanium alloy containing Ti-22V-4Al as a base and TiB and/or TiC added in a small amount) containing fine particles of TiB and/or TiC dispersed in a metal structure and disclosed in JP-A-2005-76052. In consideration of the mechanical strength of the titanium clad material to be obtained eventually, Ti-6Al-4V, Ti-15Mo-5Zr-3Al, Ti-15V-3Cr-3Al-3Sn, Ti-10V-2Fe-3Al, Ti-4.5Al-3V-2Mo-2Fe, and a high toughness titanium alloy disclosed in JP-A-2005-76052 are preferred for excellent mechanical properties such as elongation and tensile strength. The high toughness titanium alloy may be subjected to known solution aging treatment (e.g., subjecting the high toughness titanium alloy to solution treatment at 780° C. to 800° C. for 1 h, and then to aging treatment at 400 to 500° C. for 10 to 30 h). The high toughness titanium alloy is subjected to the solution aging treatment, to thereby enhance tensile strength of the high toughness titanium alloy.

Note that the fracture toughness in the present invention is measured by a $K_{IC}$ testing method in accordance with ASTM E399-90 or ISO 12737.

(Method of Producing Titanium Clad Material)

Next, a method of producing the titanium clad material of the present invention will be described.

A method of producing the clad material according to the present invention is characterized by laminating the titanium alloy composite material and high toughness titanium alloy described above in a mold, and sinter bonding the whole by a pulse electric current sintering method.

To be specific, a sheet material (or core material) formed of the titanium alloy composite material and a sheet material (or a core material) formed of the high toughness titanium alloy are arbitrarily laminated in a die (graphite die), and the whole is heated to a temperature of 950° C. to 1,100° C. with a temperature increase rate of 50° C./min to 100° C./min, for example, for sintering for 5 min to 10 min in a degree of vacuum of 1.0 Pa to 4.0 Pa under a compression load of 15 MPa to 30 MPa, to thereby bond together the sheet material formed of the titanium alloy composite material and the sheet material formed of the high toughness titanium alloy. In the sintering by the pulse electric current sintering method, neck growth between particles alone is accelerated, and coarsening of particles due to shrinkage between particles barely occurs. Thus, particle size before sintering is retained, and a sinter bonded body having a fine structure is obtained. Thus, a titanium clad material having remarkably improved mechanical properties such as tensile strength, elongation, and fracture toughness can be obtained. Note that for enhancing bonding strength between the sheet material formed of the titanium alloy composite material and the sheet material formed of the high toughness titanium alloy, surfaces to be bonded together are preferably subjected to surface treatment conventionally known in the technical field such as degreasing treatment (e.g., washing with an organic solvent) or surface polishing treatment (e.g., polishing with #600 to #1000 sand paper) in advance.

The honeycomb core material formed of the titanium alloy composite material may be produced by: punching out hexagonal pieces from a sheet material formed of the titanium alloy composite material with a laser punch or the like, and removing flash obtained after punching as required to produce a sheet material formed of the titanium alloy composite material and having a honeycomb structure; and subjecting surfaces of the sheet materials formed of the titanium alloy composite material with a honeycomb structure that are to be bonded together to surface polishing treatment and degreasing treatment, stacking together the sheet materials with good precision by using an alignment jig or the like, and sandwiching the whole by a pair of sheet materials each formed of the titanium alloy composite material. However, in the case where the titanium clad material is produced by using the honeycomb core material formed of the titanium alloy composite material, inside of the honeycomb core material is bonded in a state (e.g., a state of reduced pressure) in accordance with conditions for pulse electric current sintering. Thus, in the case where the inside of the honeycomb core material must be adjusted to the same pressure as that of a use environment of the titanium clad material, a minute vent hole may be provided on the honeycomb core material.

(Application of Titanium Alloy Composite Material and Titanium Clad Material)

The titanium alloy composite material and titanium clad material of the present invention have excellent mechanical properties such as tensile strength, elongation, Young's modulus, fracture toughness, and hardness, and can be widely used for products requiring such properties including industrial machinery, automobiles, motorcycles, bicycles, household appliances, aerospace equipment, ships and vessels, sports and leisure equipment, and medical equipment. To be specific, the titanium alloy composite material and titanium clad material of the present invention may preferably be used: for connecting rods, engine valves, valve springs, retainers, suspensions, body frames, or the like in applications for automobiles and motorcycles; for fan blades, compressor blades, discs, frames, body panels, fasteners, flags, spoilers, main gears, exhaust air ducts, fuel tanks, or the like in applications for aerospace equipment; and for artificial bones, artificial joints, implant screws, surgical instruments, or the like in applications for medical equipment.

As sports and leisure equipment, in the case where the titanium alloy composite material of the present invention is used for a face part of a golf club, for example, thickness reduction can be realized due to relative strength improvement compared with a conventional titanium alloy, to thereby increase the coefficient of rebound. The thickness reduction allows surplus weight, to thereby enhance the degree of freedom in design and allow setting of unprecedented centers of gravity. As described above, a golf club provided with a head employing the titanium alloy composite material of the present invention can extend the carrying distance and enlarge the sweet spot. Thus, a golfer can hit a ball straight with little bend.

EXAMPLES

Hereinafter, the present invention will be described in more detail by way of examples and comparative examples, but the present invention is not limited thereto.

Evaluation of mechanical properties of the titanium alloy composite material was conducted following the methods described below.

<Material Strength Measurement>

The titanium alloy composite material was cut out into a dumbbell-shaped test piece having a length of 30 mm in a rolling direction, and parallel and perpendicular directions, the length of the parallel part being 15 mm, and the width of the parallel part being 5 mm with a carbon dioxide gas laser. A strain gauge was attached to the parallel part, and strength measurement was conducted at a crosshead speed of 1 mm/min by using a material testing machine (manufactured by Shimadzu Corporation, Autograph AG-1, 100 kN).

<Young's Modulus Measurement>

Young's modulus measurement was conducted by using a modulus measuring device (manufactured by Toshiba Tungaloy Corporation, UMS-R).

<Hardness Measurement>

Hardness measurement was conducted by using a Rockwell hardness testing machine (manufactured by Akashi Corporation, ATK-F3000).

Example 1

Figure 4:
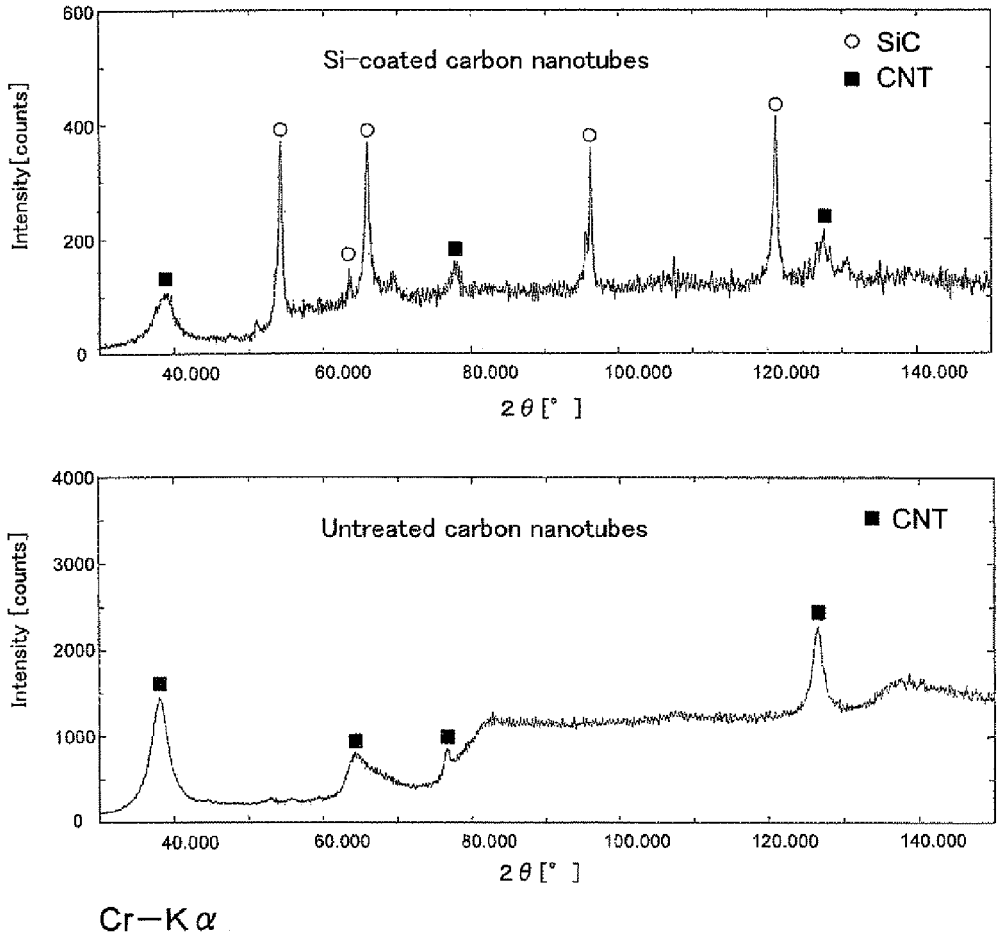
FIG. 4 Graphs showing results of X-ray diffraction measurement of carbon nanotubes coated with Si of Example 1.

20 g of multilayer carbon nanotubes having an average fiber diameter of 10 to 25 nm and an average fiber length of 10 to 50 μm and 2 g of Si powder having an average particle size of 40 μm were weighed with an electrical balance, and then were mixed in a mortar for about 30 min. The obtained mixture was charged into a 1-L tantalum vessel. A tantalum cap was placed over the container, and then the container was placed in a vacuum furnace. The vacuum furnace was heated from room temperature to 300° C. in 4 hours under vacuum to a degree of vacuum of $2\times10^{-3}$ Pa, heated to 1,400° C. in 7 hours, and maintained at 1,400° C. for 5 hours for sublimation of Si, to thereby coat a surface of the carbon nanotubes with Si. The degree of vacuum while the temperature was maintained at 1,400° C. was maintained at about $3\times100^{-3}$ Pa by Si sublimation. Then, the furnace was cooled under vacuum, to thereby obtain carbon nanotubes coated with Si. FIG. 4 shows results of X-ray diffraction measurement of the obtained carbon nanotubes. The results of X-ray diffraction measurement, and EDX analysis and observation with an ultra high resolution field emission scanning electron microscope revealed that a surface modified layer (layer containing Si and SiC) having a thickness of 0.5 nm in a thin position and about 5 nm in a thick position was formed on the surface of the carbon nanotubes.

Figure 5:
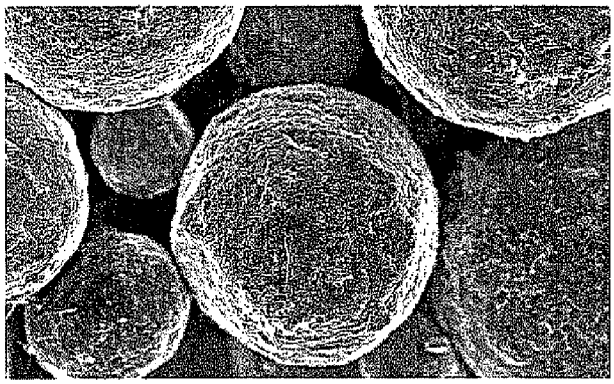
FIG. 5 An ultra high resolution FE-SEN image of titanium alloy powder containing carbon fibers fixed thereon of Example 1.

A Ti-6Al-4V alloy produced as titanium alloy powder by a powder atomization method and having a particle size distribution including 2.3% by mass of +45 μm, 20.2% by mass of 38 to 45 μm, 27.8% by mass of 25 to 38 μm, and 49.7% by mass of −25 μm was prepared. Carbon nanotubes were weighed such that they were included in an amount of 0.5% by mass in a mixture of this titanium alloy powder and the Si-coated carbon nanotubes obtained above. Mechanical impact force was applied to the mixture in an argon gas by using a hybridizer (manufactured by Nara Machinery Co., Ltd.) which is a kind of powder stirring and mixing device. As shown in FIG. 5, the carbon nanotubes were attached to the surface of the titanium alloy powder after the treatment. The carbon nanotubes attached to the surface of the titanium alloy powder were beaten by collision of the titanium alloy powder and was embedded (i.e., fixed) directly below the surface of the titanium alloy powder.

Figure 6:
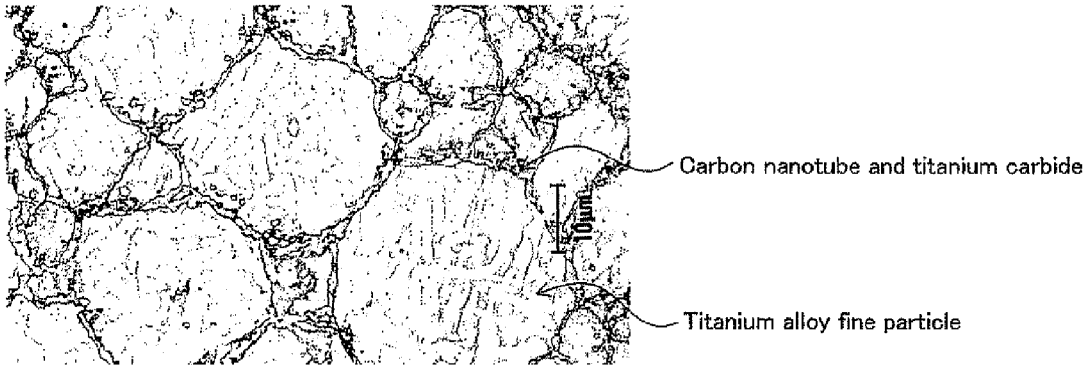
FIG. 6 A metallographic microscopic image of a metallographic structure of a sintered body of Example 1.

50 g of the raw material powder subjected to fixing treatment was weighed and charged into a graphite die of a pulse electric current sintering device. The raw material powder was pressurized at 30 MPa with a graphite cylinder, depressurized to a degree of vacuum on the order of 4 Pa, heated from room temperature to 900° C. with a temperature increase rate of 100° C./min, and maintained at 900° C. for 5 min for sintering. The obtained sintered body (i.e., intermediate) was observed with a metallographic microscope. As shown in FIG. 6, the sintered body had a structure in which the carbon nanotubes and titanium carbide formed through a partial reaction between the carbon nanotubes and titanium surrounded the titanium alloy fine particles.

Figure 7:
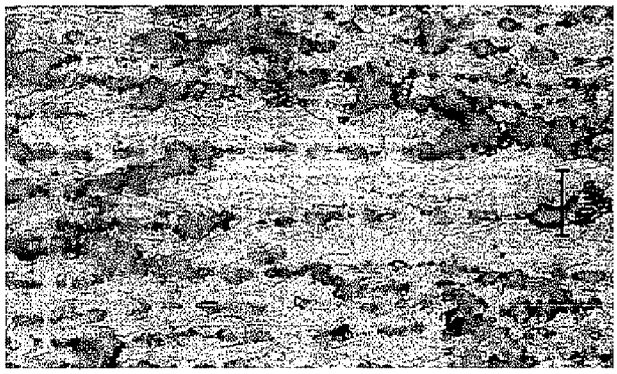
FIG. 7 A metallographic microscopic image of a metallographic structure of a titanium alloy composite material obtained in Example 1.

Next, the sintered body was cut into a size of 35 mm×35 mm×5 mm, and subjected to pack welding with a stainless steel SUS 304 sheet material for preventing oxidation during hot rolling. The cut-out piece was heated to about 800° C. by burner heating, and subjected to hot rolling in a longitudinal direction as a sheet material at a rolling strain/pass of 0.1 and a draft of 68%, to thereby obtain a titanium alloy composite material of Example 1. The obtained titanium alloy composite material was observed with a metallographic microscope. As shown in FIG. 7, the titanium alloy composite material had a structure in which the carbon nanotubes and titanium carbide were dispersed in the crystal grains of the titanium alloy.

Figure 8:
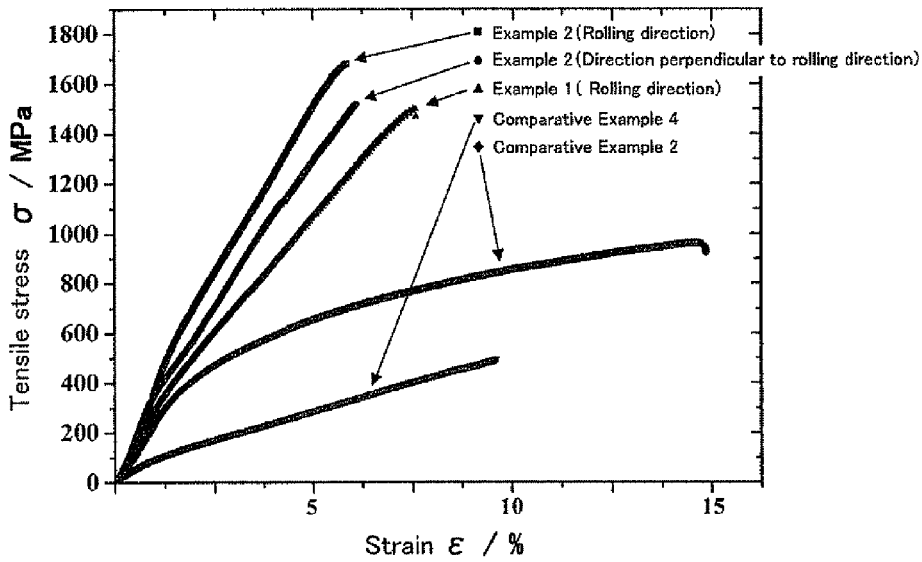
FIG. 8 A graph showing results of strength measurement of materials obtained in Examples 1 and 2 and Comparative Example 2 and 4.
Figure 9:
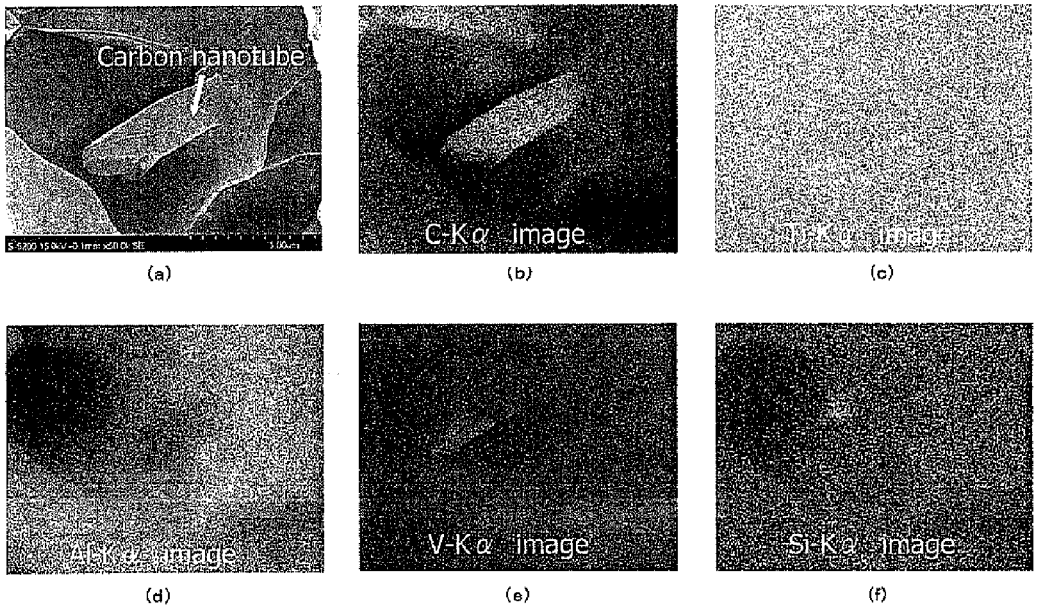
FIG. 9 Cutaway views of the titanium alloy composite material obtained in Example 1 after material strength measurement.

FIG. 8 shows the results of material strength measurement of the titanium alloy composite material of Example 1. FIG. 9 show results of observation of a broken-out section of the titanium alloy composite material after material strength measurement by using an ultra high resolution field emission scanning electron microscope (manufactured by Hitachi High-Technologies Corporation, S-5200) and an energy dispersive X-ray analyzer (manufactured by EDAX Japan Co., Ltd.). In FIG. 9(*b*) to (*f*), a light-colored part refers to a part containing a large amount of a target element. FIG. 9 revealed that the shape of the carbon nanotubes remained and the carbon nanotubes near the surface was changed to titanium carbide through a reaction with titanium. Aluminum and vanadium are components of the titanium alloy, but did not react with the carbon nanotubes. Coated Si was partly observed.

Table 1 collectively shows the results of measurement of tensile strength, Young's modulus, and hardness.

[Table 1]

TABLE 1

| | Tensile strength (MPa) | Young's modulus (GPa) | Hardness (HRC) |
|---|---|---|---|
| Example 1 | 1500 | 126 | 47.8 |
| Example 2 | 1614 | 127 | 49.0 |
| Example 3 | 1522 | 125 | 46.0 |
| Example 4 | 1556 | 125 | 45.1 |
| Example 5 | 1607 | 125 | 45.6 |
| Comparative example 1 | 1074 | 109 | 39.3 |
| Comparative example 2 | 963 | 110 | 37.9 |
| Comparative example 3 | 672 | 124 | 45.6 |
| Comparative example 4 | 493 | 121 | 44.7 |

Example 2

The titanium alloy composite material was prepared in the same manner as in Example 1, and then a pack material was removed. The titanium alloy composite material was charged into a vacuum furnace, subjected to a vacuum, and subjected to an aging treatment at 500° C. for 8 hours under an argon gas (133 Pa) replacement, to thereby obtain the titanium alloy composite material of Example 2. FIG. 8 shows the results of material strength measurement of the titanium alloy composite material of Example 2. Table 1 collectively shows the results of measurement of tensile strength, Young's modulus and hardness.

Example 3

The titanium alloy composite material of Example 3 was obtained in the same manner as in Example 2 except that: the amount of the carbon nanotubes in the mixture of the titanium alloy powder and the Si-coated carbon nanotubes was changed to 0.4% by mass; and the draft of hot rolling was changed to 77%. Table 1 collectively shows the results of measurement of tensile strength, Young's modulus, and hardness.

Example 4

Figure 10:
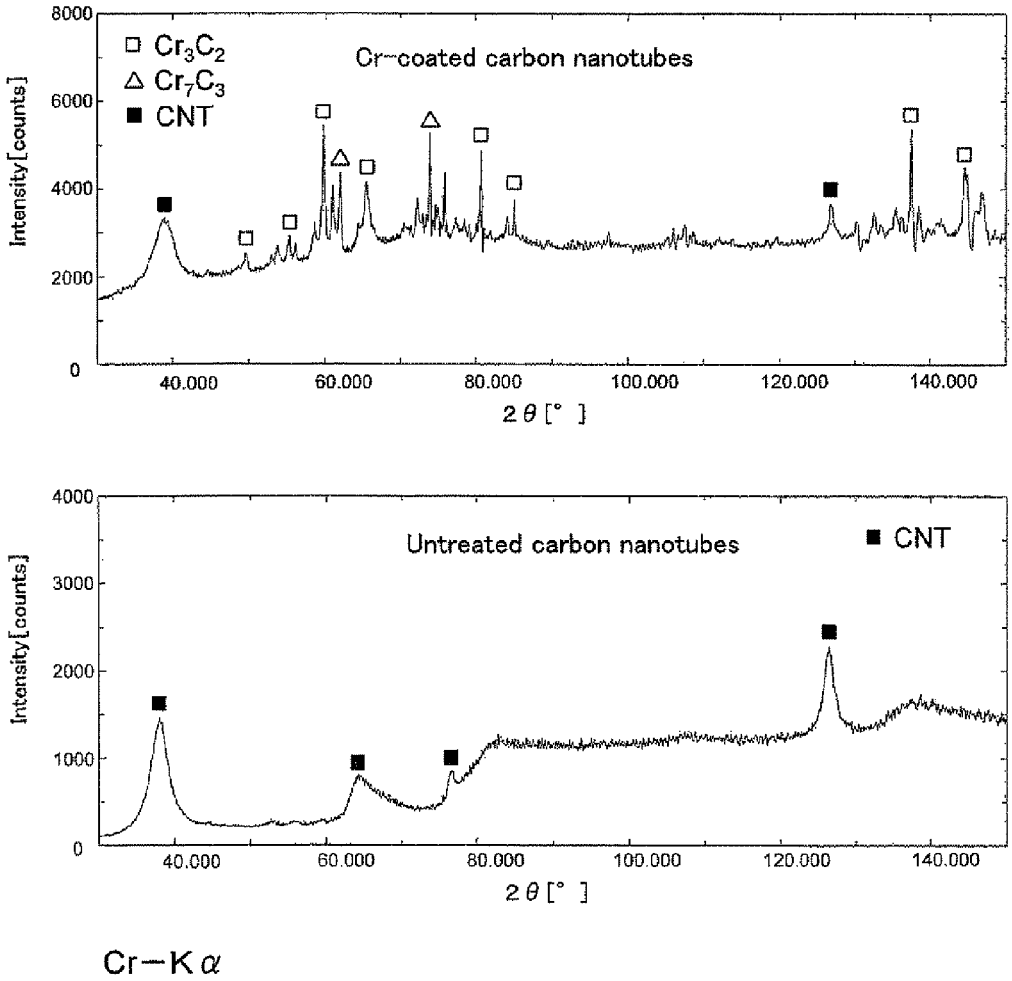
FIG. 10 Graphs showing results of X-ray diffraction measurement of carbon nanotubes coated with Cr of Example 4.

20 g of multilayer carbon nanotubes having an average fiber diameter of 10 to 25 nm and an average fiber length of 10 to 50 μm and 6 g of Cr powder having an average particle size of 10 μm were weighed with an electrical balance, and then were mixed in a mortar for about 30 min. The obtained mixture was charged into a 1-L tantalum vessel. A tantalum cap was placed over the container, and then the container was placed in a vacuum furnace. The vacuum furnace was heated from room temperature to 300° C. in 7 hours under vacuum to a degree of vacuum of $2\times10^{-3}$ Pa, heated to 1,273° C. in 4 hours, and maintained at 1,273° C. for 5 hours for sublimation of Cr, to thereby coat the surface of the carbon nanotubes with Cr. The degree of vacuum while the temperature was maintained at 1,273° C. was maintained at about $3\times10^{-3}$ Pa by Cr sublimation. Then, the furnace was cooled under vacuum, to thereby obtain carbon nanotubes coated with Cr. FIG. 10 shows results of X-ray diffraction measurement of the obtained carbon nanotubes. The results of X-ray diffraction measurement, and EDX analysis and observation with an ultra high resolution field emission scanning microscope revealed that a surface modified layer, which contains Cr, $Cr_3C_2$, and $Cr_7C_3$ and has a thickness of 1 to 2 nm in a thin position and about 3 nm in a thick position, was formed on the surface of the carbon nanotubes.

A Ti-6Al-4V alloy produced as titanium alloy powder by a powder atomization method and having a particle size distribution including 2.3% by mass of +45 μm, 20.2% by mass of 38 to 45 μm, 27.8% by mass of 25 to 38 μm, and 49.7% by mass of −25 μm was prepared. Carbon nanotubes were weighed such that the carbon nanotubes were included in an amount of 0.4% by mass in a mixture of this titanium alloy powder and the Cr-coated carbon nanotubes obtained above. Mechanical impact force was applied to the mixture in an argon gas by using a hybridizer (manufactured by Nara Machinery Co., Ltd.) which is a kind of powder stirring and mixing device, and the Cr-coated carbon nanotubes were fixed directly below the surface of the titanium alloy powder.

50 g of the above-mentioned raw material powder subjected to fixing treatment was weighed and charged into a graphite die of the pulse electric current sintering device. The raw material powder was pressurized at 30 MPa with a graphite cylinder, depressurized to a degree of vacuum on the order of 4 Pa, heated from room temperature to 900° C. with a temperature increase rate of 100° C./min, and maintained at 900° C. for 5 minutes for sintering.

Next, the sintered body was cut into a size of 35 mm×35 mm×5 mm, and subjected to pack welding with a stainless steel SUS 304 sheet material for preventing oxidation during hot rolling. The cut-out piece was heated to about 800° C. by burner heating and subjected to hot rolling in a longitudinal direction as a sheet material at a rolling strain/pass of 0.1 and a draft of 82%, and the pack material was removed. The titanium alloy composite material was charged into a vacuum furnace, subjected to vacuuming, and subjected to aging treatment at 500° C. for 8 hours under an argon gas (133 Pa) replacement, to thereby obtain the titanium alloy composite material of Example 4. Table 1 collectively shows the results of measurement of tensile strength, Young's modulus and hardness.

Example 5

The titanium alloy composite material of Example 5 was obtained in the same manner as in Example 4 except that: the amount of the carbon nanotubes in the mixture of the titanium alloy powder and the Cr-coated carbon nanotubes was changed to 0.5% by mass; and the draft of hot rolling was changed to 81%. Table 1 collectively shows the results of measurement of tensile strength, Young's modulus and hardness.

Comparative Example 1

50 g of the titanium alloy powder used in Example 1 was weighed and charged into a graphite die of the pulse electric current sintering device. The raw material powder was pressurized at 30MPa with a graphite cylinder, depressurized to a degree of vacuum on the order of 4 Pa, heated from room temperature to 900° C. with a temperature increase rate of 100° C./min, and maintained at 900° C. for 5 min for sintering. Next, the sintered body was cut into a size of 35 mm×35 mm×5 mm, and subjected to pack welding with a stainless steel SUS 304 sheet material for preventing oxidation during hot rolling. The cut-out piece was heated to about 800° C. by burner heating, and subjected to hot rolling in a longitudinal direction as a sheet material at a rolling strain/pass of 0.1 and a draft of 68%, to thereby obtain a titanium alloy composite material of Comparative Example 1. Table 1 collectively shows the results of measurement of tensile strength, Young's modulus and hardness.

Comparative Example 2

The titanium alloy composite material of Comparative Example 2 was obtained in the same manner as in Comparative Example 1 except that the hot rolling was omitted. FIG. 8 shows the results of material strength measurement of the titanium alloy composite material of Comparative Example 2. Table 1 collectively shows the results of measurement of tensile strength, Young's modulus and hardness.

Comparative Example 3

The titanium alloy composite material of Comparative Example 3 was obtained in the same manner as in Example 2 except that the multilayer carbon nanotubes were directly used without Si coating. Table 1 collectively shows the results of measurement of tensile strength, Young's modulus and hardness.

Comparative Example 4

The titanium alloy composite material of Comparative Example 4 was obtained in the same manner as in Example 1 except that the hot rolling was omitted. FIG. 8 shows the results of material strength measurement of the titanium alloy composite material of Comparative Example 4. Table 1 collectively shows the results of measurement of tensile strength, Young's modulus and hardness.

The results revealed that the titanium alloy composite material of each of Examples 1 to 5 had a tensile strength of 1,500 MPa or more and a Young's modulus of more than 120 GPa, and thus had significantly improved mechanical strength than that of conventional titanium alloys (Comparative Examples 1 and 2).

Meanwhile, the titanium alloy composite material of Comparative Example 4 produced by omitting the hot rolling, which means no carbon nanotubes were dispersed in the crystal grains of the titanium alloy, had a low tensile strength of 493 MPa, and thus had a mechanical strength more significantly degraded than those of the conventional titanium alloys (Comparative Examples 1 and 2). In the titanium alloy composite material of Comparative Example 4, the carbon nanotubes or titanium carbonate was present on a periphery of titanium alloy fine particles like a shell of a boiled egg, and served as the origins of cracks. Thus, sufficient mechanical strength presumably cannot be obtained.

The titanium alloy composite material of Comparative Example 3 employing the carbon nanotubes without Si coating had mechanical strength more degraded than those of the conventional titanium alloys (Comparative Examples 1 and 2). In the titanium alloy composite material of Comparative Example 3, bonding between the titanium alloy and the carbon nanotubes was insufficient, and thus sufficient mechanical strength presumably cannot be obtained.

Evaluation of the mechanical properties of the titanium clad material was conducted following the procedure described below.

<Material Strength Measurement>

A target material was cut out into a dumbbell-shaped test piece having a length of 30 mm in a rolling direction, and parallel and perpendicular directions, a length of a parallel part of 15 mm, and a width of the parallel part of 5 mm with a carbon dioxide gas laser. A strain gauge was attached to the parallel part, and strength measurement was conducted at a crosshead speed of 1 mm/min by using a material testing machine (manufactured by Shimadzu Corporation, Autograph AG-1, 100 kN).

<Elongation Measurement>

A strain gauge was attached to the parallel part of the test piece of the target material through an adhesive, and a lead wire of the strain gauge was connected to a bridge. Then, the whole was set in a material testing machine through a strain meter for elongation measurement.

<Fracture Toughness Measurement>

The fracture toughness measurement was conducted by a $K_{IC}$ testing method in accordance with ASTM E399-90 or ISO 12737. Introduction of a fatigue precrack and measurement of fracture toughness were conducted with an electro-hydraulic servo fatigue testing machine (MTS 810 Test Start II).

Example 6

The elongation and fracture toughness $K_{IC}$ of the titanium alloy composite material (thickness of 1.6 mm) obtained in Example 2 were measured. The elongation was 6%, and the fracture toughness $K_{IC}$ was 45.1 MPa·m$^{1/2}$.

Next, the titanium alloy composite material of Example 2 and a Ti-4.5Al-3V-2Mo-2Fe sheet material (available from JFE Steel Corporation, SP-700, thickness of 1.0 mm, subjected to solution aging treatment at 510° C. for 1 hour) as a high toughness titanium alloy were laminated into a graphite die of the pulse electric current sintering device. The whole was pressurized at 30 MPa with a graphite cylinder, depressurized to a degree of vacuum on the order of 4 Pa, heated from room temperature to 950° C. with a temperature increase rate of 100° C./min, and maintained at 950° C. for 5 min for sintering, to thereby obtain the clad material of Example 6 containing the titanium alloy composite material and the high toughness titanium alloy bonded together. This titanium alloy composite material had a tensile strength of 1,425 MPa, an elongation of 9.7%, and a fracture toughness $K_{IC}$ of 50.4 MPa·m$^{1/2}$. Meanwhile, the high toughness titanium alloy (i.e., conventional titanium alloy) used above had a tensile strength of 1,213 MPa, an elongation of 14.4%, and a fracture toughness $K_{IC}$ of 55.8 MPa·m$^{1/2}$.

Figure 11:
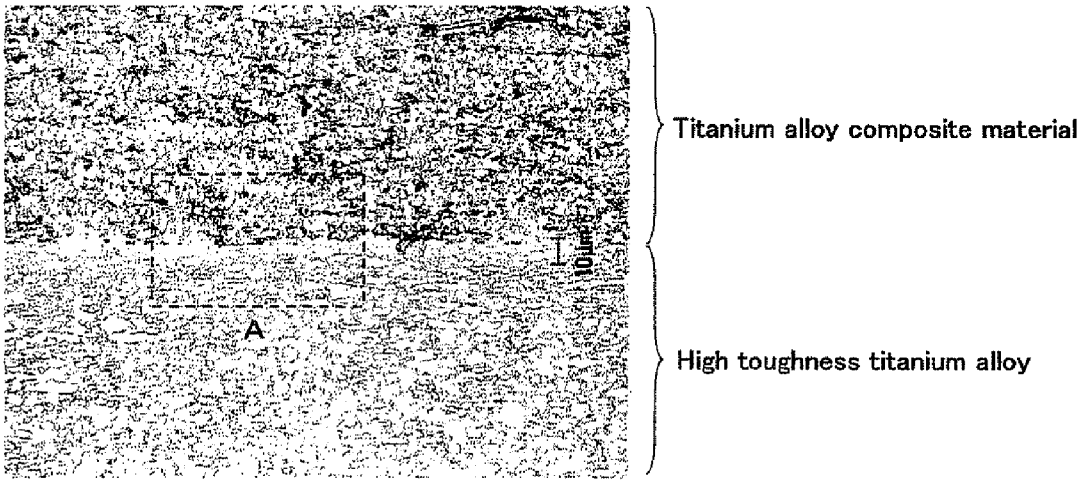
FIG. 11 A metallographic microscopic image of a vicinity of a sinter bonded interface of a titanium clad material of Example 6.
Figure 12:
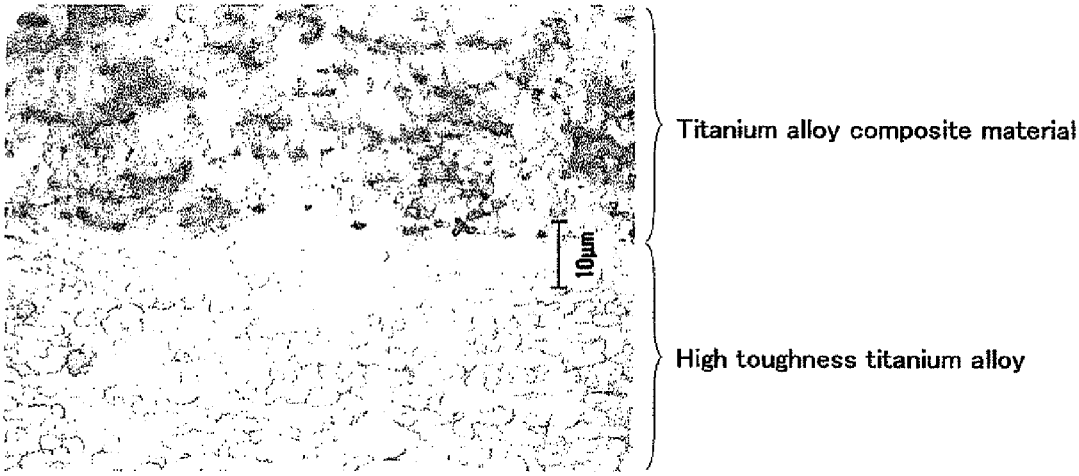
FIG. 12 An enlarged image of part A of FIG. 11.

FIG. 11 shows a metallographic microscopic image of the vicinity of a sinter bonded interface of the titanium clad material of Example 6, and FIG. 12 shows an enlarged image of an A part of FIG. 11. The metallographic microscopic images suggest that in the titanium clad material of Example 6, the titanium alloy composite material and the high toughness titanium alloy are favorably sinter bonded together.

The results revealed that the titanium clad material of Example 6 contained the titanium alloy composite material and the high toughness titanium alloy favorably sinter bonded together, and thus had a tensile strength of more than 1,400 MPa, an elongation of more than 9%, and a fracture toughness of more than 50 $MPa \cdot m^{1/2}$, which are mechanical properties more remarkably improved than those of the conventional titanium alloys.

The invention claimed is:

1. A titanium alloy composite material comprising carbon nanotubes coated with a layer comprising an unreacted element and a carbide of the element, wherein the coated carbon nanotubes are dispersed in crystal grains of the titanium alloy.

2. The titanium alloy composite material according to claim 1, wherein the element comprises at least one element selected from the group consisting of silicon (Si), chromium (Cr), titanium (Ti), vanadium (V), tantalum (Ta), molybdenum (Mo), zirconium (Zr), boron (B), and calcium (Ca).

3. The titanium alloy composite material according to claim 1, wherein the titanium alloy composite material comprises 0.1% to 10% by mass of the carbon nanotubes.

4. The titanium alloy composite material according to claim 1, wherein the layer has a thickness of at least 0.5 nm.

5. The titanium alloy composite material according to claim 1, wherein the carbon nanotubes have a diameter of 2 nm to 80 nm.

6. The titanium alloy composite material according to claim 1, wherein the carbon nanotubes have a length of 1 μm to 100 μm.

7. A titanium clad material comprising a titanium alloy composite material comprising carbon nanotubes coated with a layer comprising an unreacted element and a carbide of the element, wherein the coated carbon nanotubes are dispersed in crystal grains of the titanium alloy, and a titanium alloy having a higher fracture toughness than the titanium alloy of the composite material, sinter bonded to one another.

8. The titanium clad material according to claim 7, comprising a pair of sheets made of the titanium alloy having a higher fracture toughness than the titanium alloy composite material, and a core material made of the titanium alloy composite material located between the sheets.

9. The titanium clad material according to claim 8, wherein the core material has a honeycomb structure.

10. A method of producing a titanium clad material comprising:

laminating in a mold a titanium alloy composite material comprising carbon nanotubes coated with a layer comprising an unreacted element and a carbide of the element, wherein the coated carbon nanotubes are dispersed in crystal grains of the titanium alloy, and a titanium alloy having a higher fracture toughness than the titanium alloy composite material; and sinter bonding the titanium alloy composite material and the titanium alloy to one another with pulsed electric current.

* * * * *